US012404143B2

(12) United States Patent
Vandenbrande et al.

(10) Patent No.: US 12,404,143 B2
(45) Date of Patent: Sep. 2, 2025

(54) CREEL SYSTEM

(71) Applicant: GILBOS N.V., Herdersem (BE)

(72) Inventors: Sigurn Vandenbrande, Dentergem (BE); Bart De Smedt, Ledeberg (BE)

(73) Assignee: GILBOS N.V., Herdesem (BE)

( * ) Notice: Subject to any disclaimer, the term of this patent is extended or adjusted under 35 U.S.C. 154(b) by 291 days.

(21) Appl. No.: 18/004,967

(22) PCT Filed: Jul. 14, 2021

(86) PCT No.: PCT/IB2021/056343
§ 371 (c)(1),
(2) Date: Jan. 10, 2023

(87) PCT Pub. No.: WO2022/013773
PCT Pub. Date: Jan. 20, 2022

(65) Prior Publication Data

US 2023/0339719 A1 Oct. 26, 2023

(30) Foreign Application Priority Data

Jul. 14, 2020 (BE) ..... 2020/5527

(51) Int. Cl.
*B65H 69/00* (2006.01)
*B65H 49/16* (2006.01)
(Continued)

(52) U.S. Cl.
CPC ..... *B65H 69/00* (2013.01); *B65H 2701/31* (2013.01)

(58) Field of Classification Search
CPC ..... B65H 49/16; B65H 49/14; B65H 49/10; B65H 49/38; B65H 2701/31; B65H 69/00;
(Continued)

(56) References Cited

U.S. PATENT DOCUMENTS 1,765,590 A * 6/1930 Javery ..... D02H 1/00 242/131.1
2,458,555 A * 1/1949 Bouvet ..... D02H 13/00 28/187
(Continued)

FOREIGN PATENT DOCUMENTS

CN 117284879 A * 12/2023 ..... B65H 49/12
DE 4442231 A1 6/1995
(Continued)

OTHER PUBLICATIONS

ISR-WO for parent application PCT/IB2021/056343 and dated Oct. 11, 2021.

*Primary Examiner* — Anna M Momper
*Assistant Examiner* — Katelynne R Burrell
(74) *Attorney, Agent, or Firm* — Vorys, Sater, Seymour and Pease LLP

(57) ABSTRACT

A system for connecting successive bobbins, in which the yarns of the different bobbins on the creel are connected to each other and are thus presented as one long yarn to the subsequent process. The system includes a plurality of devices for transporting and positioning a bobbin with yarn for provision in a creel. The system also includes a creel system that further includes a plurality of receiving positions, each of the receiving positions adapted to receive one of the devices. The devices are provided with one or more engaging elements, and the receiving positions are provided with one or more engaging mechanisms for connecting to the engaging elements.

13 Claims, 6 Drawing Sheets

(51) Int. Cl.
*B65H 49/38* (2006.01)
*D02H 1/00* (2006.01)

(58) Field of Classification Search
CPC ..... B65H 75/28; B65H 2701/534; B65H 75/285; D02H 1/00; D02H 3/00; D02H 5/00; D02H 7/00; D03J 1/16; D03J 1/18
USPC ..... 242/473.5
See application file for complete search history.

(56) References Cited

U.S. PATENT DOCUMENTS 2,483,160 A * 9/1949 Suggs ..... D02H 1/00 211/85.5
3,602,456 A * 8/1971 Schmidt ..... D02H 1/00 242/131.1
3,858,827 A * 1/1975 Glassbrook ..... B65H 49/04 242/154
4,515,328 A * 5/1985 Payne, Jr. ..... D01H 9/18 414/331.03
4,545,547 A * 10/1985 Singer ..... B65H 49/16 242/131
4,572,458 A * 2/1986 Bluhm ..... B65H 57/12 242/131
4,836,468 A * 6/1989 Singer ..... B65H 57/22 242/131
5,624,082 A * 4/1997 Ligon ..... D03D 47/34 242/131
7,802,749 B2 * 9/2010 Chadwick ..... B65H 57/04 242/131
2011/0127364 A1 * 6/2011 Rees ..... B65H 59/06 242/594
2012/0217337 A1 * 8/2012 Barea ..... B65H 49/16 242/590
2015/0225203 A1 * 8/2015 Hoover ..... D04B 15/42 242/131
2015/0291383 A1 * 10/2015 Barea ..... D02H 1/00 242/564
2019/0177108 A1 * 6/2019 Charles ..... B65H 67/02

FOREIGN PATENT DOCUMENTS

DE 10059993 A1 6/2002
EP 0534633 A1 3/1993
WO 2022/013773 A1 1/2022

* cited by examiner

CREEL SYSTEM

TECHNICAL FIELD

The invention relates to a creel system, among other things for connecting the yarn to another bobbin, in which the yarns of the different bobbins on the creel are connected to each other and are thus presented as one long yarn to the subsequent process (tag ending).

PRIOR ART

In the prior art bobbins with yarn are supplied for transfer to a creel, the bobbins typically being positioned vertically on a pallet, or horizontally in carts, upon delivery. The creel is herein provided with a number of carriers (typically elongate rods or clamping devices), over which a bobbin can be slid for holding the bobbins. In certain systems, robotic arms are provided that pick up the reels and then position them on the carriers of the creel. Alternatively, this (possibly partially, for example via cobot) is performed manually.

However, there are a large number of drawbacks associated with this. On the one hand, the implementation of robotics is often a major barrier due to cost, all the more so because it is often limited to just handling the bobbin and not connecting successive bobbins, and the scale must also be large enough for this to be efficient. On the other hand, performing this manually is disadvantageous in terms of ergonomics for the worker, and still requires too great a worker's effort and time investment.

In other systems, a conveyor (conveyor belt or otherwise) is still needed between the delivery and the creel itself, where the bobbins are often already slid onto an intermediate carrier (cone-like extension) that is perpendicular to the conveyor in order to be immobilised during transport. It should be noted, however, that sags of the yarn very often occur due to gravity, especially if the knot holding the bobbin closed is loosened, causing the yarns to roll off the bobbin, making it almost unmanageable. Moreover, this does not change the problems when placing the bobbins on the creel itself.

Finally, it is also very important not to touch the yarn—or as little as possible—when handling the bobbin, as this can cause sagging, but also weakening, damage and eventually even breakage.

A second disadvantage is linked to the tag ending process itself, where the yarns of bobbins are joined together. To do this, it is necessary to detect and fix the yarn ends, in order to then be able to connect them to yarn ends of other bobbins. This process must be performed at the time of positioning the bobbin on the creel, or afterwards (but before the next process), which is not obvious, however, as this action is complicated by the presence of the bobbins on/in the creel. Another aspect is the fact that finding a tag end is not always certain and can be time consuming. This time uncertainty is not desirable in this time-critical zone.

The term 'leading end' or 'starting end' refers to the freest yarn end of the bobbin yarn wherefrom the yarn can be completely unwound from the bobbin.

The term 'tag end' or 'tail end' refers to the other yarn end of the bobbin yarn, which is released upon unwinding of the bobbin, and wherefrom the yarn typically cannot be completely unwound from the bobbin.

Existing systems are described in DE4442231A1, EP0534633A1 and DE10059993A1, but fail to describe a reliable, compact and easily loadable system.

SUMMARY OF THE INVENTION

The invention relates to a system for holding bobbins with yarn and joining the yarns of the bobbins to produce an elongated yarn (tag ending), said system comprising:

a. a plurality of devices for conveying and positioning a bobbin of yarn for provision in a creel, the devices as described herein, the devices preferably forming assemblies as described herein;

b. a creel system comprising a plurality of receiving positions, each of the receiving positions adapted to receive one of the devices, which receiving positions are grouped into pairs of two receiving positions;

wherein the devices are provided with one or more engaging elements, and the receiving positions are provided with one or more engaging mechanisms for connecting to the engaging elements, the engaging mechanisms of the receiving positions of each pair being positioned such that:

the carriers of the devices received in the pair of receiving positions are orientated towards a common run-off point; and the first fixing member of the first direction interfaces with the second fixing member of the second device; and the second fixing member of the first direction interfaces with the first fixing member of the second device; and wherein interfacing fixing members have a minimum mutual distance which is at most 250 mm, preferably at most 100 mm, with further preference at most 50 mm, and most preferably at most 25 mm.

The invention herein comprises devices for holding a bobbin with yarn for provision in a creel. This device is adapted to be easy to place in the creel, preferably without additional elements and thereby correctly positioning the bobbin (quasi) immediately for continuous unwinding for the next process, and at the same time fixing the yarn ends (leading and tag end) for easy connection of the tag end of the yarn on a first bobbin with the leading end of the yarn on a second bobbin positioned adjacent. Once the first bobbin is completely unwound, the device with this bobbin can be removed and replaced with a new 'full' device, which in turn is connected with its leading end to the tag end of the previous second bobbin. In addition, the device can also be adapted for simple transport to the creel, wherein the bobbin can be kept substantially horizontal. Two 'coupled' devices side by side in the creel and intended to be connected at the yarn ends for continuity of yarn unwinding will be referred to in the text as an 'assembly'.

A first advantage is that the device according to the invention ensures that when two devices of an 'assembly' are placed in the creel, they are correctly orientated and the axes of the bobbins are directed towards a common run-off point, towards which the yarn of the bobbins is unwound.

If the axis of the bobbins is positioned perpendicular to the 'base' of the device, this has the disadvantage that a more complex movement is expected of the positioning robot, and that the creel becomes larger and/or more expensive, because it is always desirable that the axis of the bobbins point to a common run-off point once they are in the creel.

A second advantage is that the device provides a carrier for the bobbins that is not vertical, thus reducing or even completely eliminating the risk of the yarn sliding or rolling off the bobbin.

A third and crucial advantage is that the device comprises a specifically adapted means for holding the yarn ends in a specific manner such that they are positioned relatively closely and if possible, correctly aligned with the corresponding yarn ends on the adjacent device, and thus makes connecting very easy. Heretofore, finding the yarn ends has been performed once the bobbin has been placed in the creel, and it is this which in practice proves very difficult to perform in-line. By providing fixing members on the device itself, the yarn ends can already be positioned for the placement of the bobbin in the creel and the time uncertainty is gone.

In the first instance, the invention relates to a device according to claim 1.

By working with fixing members with a known positioning (distance and/or orientation) with respect to the carrier, a connecting mechanism with the creel can moreover be provided, whereby the carriers and the yarn ends end up in the desired position when the device is placed in the creel.

In order to position the device in space at a particular location and orientation, there is a preferred embodiment wherein the device comprises at least three non-collinear support points, preferably mutually rigidly connected (e.g. on a shared component, or on components that are rigidly connected to each other), which define a substantially flat support surface, the bobbin carrier being connected to the support points via the support element. This embodiment makes it possible to transport the device via a conveyor belt or other (flat) transport mechanisms.

Providing the three support points, or even support surface, can make it possible to fix the six degrees of freedom of the device when positioning in the creel, for instance by engaging thereon. In this way it can be ensured that the axis (extension) of the carrier points to the desired run-off point. It will be apparent to a person skilled in the art that fixing the positioning can be achieved in various ways, for instance by clamping a ball joint or other elements. The fixation can take place by locking and/or clamping the element or elements on which the support points are located.

The term 'support surface' can refer here to a 'solid' surface, or to a frame that is substantially hollow. Both can be used for the fixation of the device in a creel, by engaging them.

In a preferred embodiment, at least one, preferably both, of the fixing members comprises at least two holders for holding the yarn ends, the holder(s) of each fixing member defining a tension line along which the yarn end is tensioned at said fixing member. In other embodiments, one or both yarn ends are held by one holder on the fixing member and by the bobbin itself on which the yarn resides, the one holder and bobbin thus defining the tension line. It should therefore be understood that in certain embodiments, one fixing member may use the first version (two holders), and the other fixing member the other version (one holder). For example, the first mechanism can be useful for holding the leading end, where the location from which this end is released from the bobbin cannot always be predicted.

In addition, it should be noted that the holders do not necessarily clamp the yarn ends effectively (or not both in the case of two holders). For example, a first holder can serve as a guide (for example a hook over which the yarn runs), while the second holder fixes the end of the yarn. Fixing here is typically also holding in such a way that the yarn ends could not come loose by themselves, but that an external force (unwinding) would be required for this.

The term 'interfacing' in reference to the fixing members refers to the condition of the fixing members, and in particular the yarn ends held therein, when the devices are correctly positioned in a creel (i.e. side by side, with the carrier facing a predetermined run-off point or unwinding point), wherein the fixing members of the two devices are sufficiently close to each other to allow connection of a yarn end of the bobbin on one device to a yarn end of the bobbin of the other device as expected by tag ending. In practice, some tolerance is possible here, but the distance between the two yarn ends to be joined should remain limited, depending on the system for joining, which is achieved in the invention. Interfacing fixing members shall have a minimum distance between them that does not exceed 250 mm.

In a preferred embodiment, one of the fixing members is positioned more proximally relative to the first end of the carrier than the other of the fixing members, preferably with one of the fixing members acting to fix the tail end of the yarn. Typically, the free length of the tail end is limited as it is or may be trapped in part by the remainder of the yarn wound around the sleeve.

In a preferred embodiment, the carrier is provided with a bobbin fixing element, or system or mechanism, for retaining a bobbin on the carrier and inhibiting movement of the retained bobbin along the length of the carrier, preferably wherein the bobbin fixing element comprises a passive clamping system.

In a preferred embodiment, the carrier is provided with a rotational bobbin fixing element for retaining a bobbin on the carrier and inhibiting rotation of the retained bobbin about an axis substantially along the carrier, preferably wherein the rotational bobbin fixing element comprises a passive clamping system, at preferably wherein the rotational bobbin fixing element is the bobbin fixing element.

In an alternative embodiment, the (regular and/or rotational) bobbin fixing element is an active clamping system. The clamping system can be, for example, a monostable element that wishes to return to a preferred position/shape, thereby clamping the bobbin (for example systems with spring loads). Alternatively, a bistable element may be provided, which has an open (non-clamping) position and a closed (clamping) position, allowing easy positioning of the bobbin and efficient clamping. In this way the bobbin fixing element can also allow clamping of a great diversity of bobbins (both in length and diameter). Variations in the dimensions of the bobbins can also be accommodated in this way.

In a possible embodiment, the device is provided with an identification—whether or not unique—, e.g. via barcode, QR code, RFID tag, LCD screen, LED(s), serial number or other, which can be read. Note that this can also be used in any embodiment of the invention for traceability of any device and bobbin. Other systems can also be used for this purpose, such as cameras, timer, FIFO monitoring system.

In what follows, the term 'interfacing devices' will be used to refer to devices whose fixing members interface as previously described, namely wherein the first fixing member of the first device and the second fixing member of the second device interface, and the first fixing member of the second device and the second fixing member of the first device interface.

One of the features of the present invention is that the devices can be used together in a creel such that they complement each other when properly placed. The correct placement depends in part on the receiving mechanism of the creel and the coupling of the devices, but the devices themselves are adapted so that when the fixing members interface (crosswise, with the first fixing member of the first device interfacing with the second of the other device and the second fixing member of the first device interfacing with the first of the other device), the carriers are automatically directed to a common run-off point. The advantages of this are clear when looking at the placement in the creel. There, bobbins are placed in pairs or clusters, whereby a first bobbin is unwound and in the meantime its tag end is linked to the leading end of the next bobbin. As indicated, finding the yarn ends, as well as connecting them between devices, is not always obvious. The proposed assembly allows not only to find and hold the yarn ends beforehand, but also to position them automatically with respect to the other device during placement in the creel so that they can be connected.

In preferred embodiments, the fixing members (or, at least, where the yarn ends are held) are located substantially in a plane perpendicular to the bisector formed by the two carriers when the carriers face a same run-off point and the fixing members interface as previously discussed. Alternatively, the fixing members of the two devices may all be equidistant from the plane defined by the two carriers when the carriers are directed at the same run-off point and the fixing members interface as previously discussed, and the fixing members are in one plane perpendicular to the bisector of the two carriers. An embodiment according to this variant can also be seen in FIGS. 4A-D.

In a preferred embodiment, in the at least one mutual positioning in which the carrier of the first device and the carrier of the second device are directed with the free ends towards a common run-off point, the common run-off point is at a maximum of 2.0 m from the free ends of the devices, preferably at a maximum of 1.5 m, with further preference a maximum of 1.0 m. Preferably, the above distance of removal is at least 5.0 cm, more preferably at least 10.0 cm, more preferably at least 20.0 cm.

It goes without saying that when talking about the distance between interfacing fixing members, it is preferably kept as low as possible so that the joining of the yarn ends can be performed as reliably as possible with minimal manipulation of the yarn ends. For example, this distance can be a maximum of 200 mm, 150 mm, 75 mm, 40 mm, between the above-mentioned distances, but can also be lower, such as 24 mm, 20 mm, 15 mm, 10 mm, 5 mm or even lower.

The invention allows herein, through the specific configuration of the devices, to place them in the creel under a position and orientation that automatically ensures that neighbouring devices can be connected to the yarn ends (with fixing members of the devices interfacing with each other at appropriate distances). Preferably, the engaging elements and engaging mechanisms are adapted such that the devices can be placed in the receiving position in only one way (uniquely connectable, preferably in a fixed mutual orientation), thereby automatically coming into the desired orientation with carrier and fixing members. Particularly in devices where the carrier and fixing members have a fixed mutual orientation, this ensures the immediate possibility of commissioning with minimal requirements for a user.

For instance, the engaging elements and mechanisms can come down to a (partially) hollow carrier which is slid over a corresponding projection which is part of the receiving position, and which is for instance secured thereto via rotation (or via another mechanism). By choosing the shape, it can be ensured that there is only one way to connect them, thus fixing the orientation.

In a possible embodiment, the devices have support points or even a support surface/support plate as discussed earlier. Use can be made of this to implement the coupling between creel system and device and to engage on these support points/plane/plate.

This can be done, among other things, by receiving a support plate in C-shaped profiles, so that the correct orientation is again ensured. These embodiments can be seen, inter alia, in FIGS. 1-5.

In a preferred embodiment, the engaging mechanisms are adapted for releasably fixing or positioning the devices, wherein the fixing or positioning of a device in an engaging mechanism prevents rotation and translation of the device relative to the receiving positions. This can take place via a passive and/or active fixation, for instance interacting connectors on the engaging mechanism and/or engaging element (snap-fit and the like).

In a preferred embodiment, the creel system comprises one or more connecting devices for connecting yarn ends to interfacing fixing members. The connecting devices are preferably movable, whether or not automated since this allows greater freedom of movement for placing the devices at the receiving positions. Preferably, the connecting devices are or comprise splicing devices for splicing the yarn ends. Alternatively, the connecting devices are knotting means for knotting the yarn ends, gluing devices for fixing yarn ends together, or fusing devices for connecting the yarn ends.

In a preferred embodiment, it is desirable to connect the tag end of a bobbin on one device (which is being unwound) to the leading end of a bobbin on the other device of a pair of devices in the creel. For this reason, it is preferable, when connecting via splicing, for instance—or other techniques—to carry this out on intersecting yarn ends. On the one hand, the fixing members are configured to hold the yarn ends in one position (e.g. with one clamp), so that loose yarn ends extend beyond the fixing members. The system comprises a connecting device, preferably a splicing device, and at least one feeding device. The feeding device is configured to suck the loose yarn ends of the tag end of the bobbin on one device with a first suction device, and suck the leading end of the bobbin on the other device with a second suction device. These suction devices may comprise, for example, Venturi nozzles. As a result, the loose yarn ends are somewhat fixed at one position (in the holder) and they still have some freedom of movement at the loose end thereof, with a minimum pulling force, in and out of the suction device. Once sucked, the feeding device is translated in a specific direction and/or rotated or pivoted around an axis intersecting the connecting line between the fixing members of the yarn ends in such a way that the yarn ends now being sucked (which are being held between the suction device and fixing members) intersect between the suction devices and the fixing members. By knowing the distance between the suction members and the fixing members and their mutual position after the translation or rotation, it is possible to know in advance where the sucked yarn ends will intersect, and to provide at that position the connecting device (e.g. splicing device, in the form of a splicing chamber), so that the two intersecting sucked yarn ends can be connected via air pulses. Of course, still further movements (e.g. translation or rotation) can be made on the splicing device and/or on the other elements (preferably on the splicing device) to ensure that the intersecting sucked yarn ends are provided in the desired position.

It is alternatively possible to achieve the same result with other connecting techniques, and thereby also make use of the above technique for supplying and intersecting provision of the loose yarn ends.

Note that in a variation, only one of the two suction devices can be translated/rotated/pivoted to achieve the same effect, i.e. crossed yarn ends.

DESCRIPTION OF THE DRAWINGS

FIG. 1A shows a rear view as in transit, FIG. 1B shows a rear view of the two devices in the creel, and FIG. 1C shows a top view in the creel, as well as movement during placement.

FIG. 2A shows a rear view as in transit, FIG. 2B shows a rear view of the two devices in the creel, and FIG. 2C shows a top view in the creel, as well as movement during placement.

FIG. 5A shows a rear view as in transit. FIG. 5B shows a rear view of the two devices in the creel, and FIG. 5C shows a top view in the creel, as well as the movement during placement.

DETAILED DESCRIPTION

Unless otherwise defined, all terms used in the description of the invention, including technical and scientific terms, have the meaning as commonly understood by a person skilled in the art to which the invention pertains. For a better understanding of the description of the invention, the following terms are explained explicitly.

Quoting numerical intervals by endpoints comprises all integers, fractions and/or real numbers between the endpoints, these endpoints included.

In a preferred embodiment of the device, the carrier extends at least 100 mm, preferably at least 200 mm and more preferably at least 300 mm or 400 mm, relative to the support element.

In a preferred embodiment of the device, the device is provided with at least one screen substantially parallel to the carrier, said screen positioned at a distance from the carrier to prevent ballooning of a descending yarn.

Said screen serves to prevent ballooning of the yarn during unwinding. Ballooning occurs if the yarn gets a certain amount of slack and/or there is cyclical variation in tensile force during the unwinding. If this is the case, the yarn may swing wider and wider during the unwinding, which should be limited as this can lead to breakage. By providing a screen at an appropriate distance, ballooning is limited. This screen can be provided on one side, or on several sides, but can also be provided curved around a part of the carrier (for example over a segment between 20° and 180°).

In a preferred embodiment of the second version of the second aspect of the invention, the support surface of the device rotated 180° is retained in the creel, thus keeping the device suspended.

In a preferred embodiment of the third version of the second aspect of the invention, the support surface of the device is retained in the creel and thus the device is kept suspended.

EXAMPLES

In what follows, reference will be made to an angle $\alpha$ between the carriers of two 'paired' devices in a creel (i.e. devices with interfacing fixing members). This angle may vary depending on the creel, the type of yarn, as well as specific parameters or preferred settings. It should therefore be understood that all variations thereof are still within the scope of the invention. Preferably, this angle $\alpha$ is about 60-70°, but can equally be between 40° and 60° (or lower) or between 70° and 90° (or higher).

Example 1

Figure 1A:
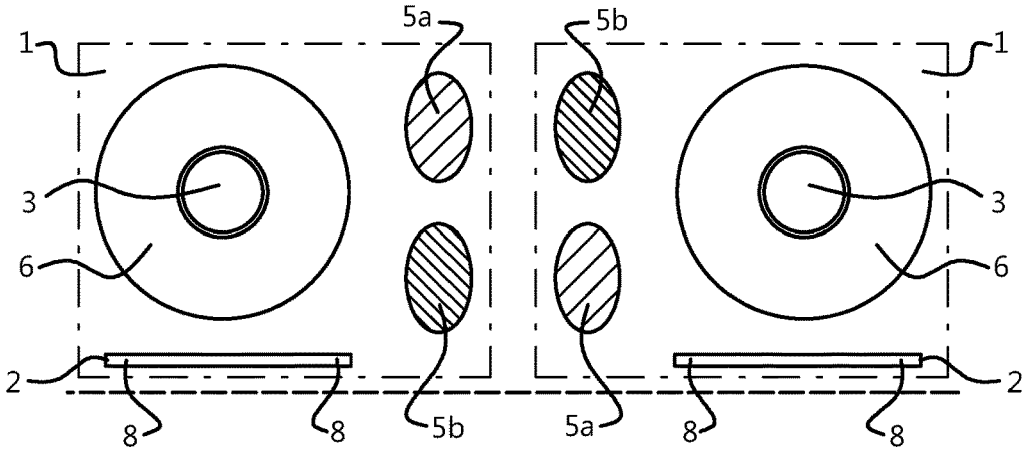
FIGS. 1A-C show a schematic representation of a first variation of a possible embodiment of the device, as well as the placing of an assembly of two devices in a creel.
Figure 1B:
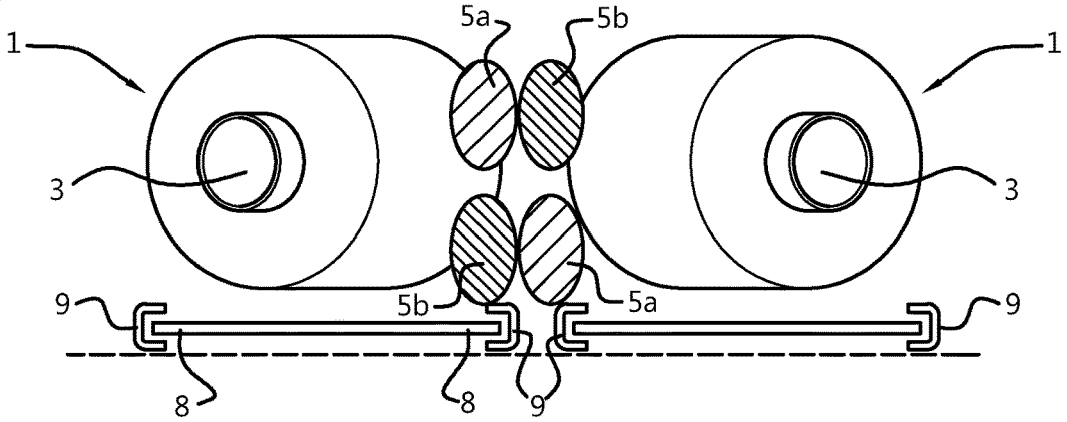
Figure 1C:
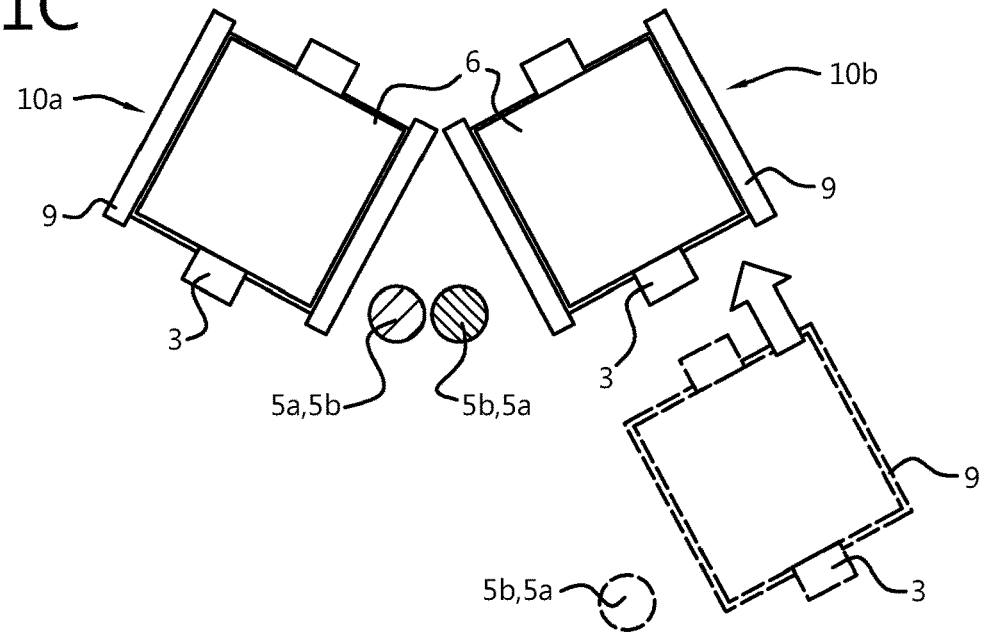

In a first embodiment of the first example (first aspect), visible in FIGS. 1A-C, a basic embodiment of the invention is described. FIG. 1A shows the rear view of a device in transit, in which the carrier is parallel to the sides of the support plate, necessitating an angled placement in the creel (see FIGS. 1B and 1C). Herein, in practice, two separate types of devices (1) are used which is a substantially mirrored configuration, a left and a right version. The device herein comprises a support plate (2) comprising at least three non-collinear support points. Parallel to this, an elongate carrier (3) is provided to hold a bobbin (6), connected to the support surface at one end of the carrier via an upright support element. The device (1) is further provided with two fixing members (5) (whether or not combined on a single element) each with one or two holders for holding yarn ends of the bobbin (6). The support plate is preferably rectangular or square.

In this first example, a number of variations are possible which depend on the creel itself, and also affect the method of placing the devices on the creel.

In a first embodiment, the creel has paired receiving positions which are at an angle to each other, which angle is substantially equal to a. In this version, the support surfaces are approximately rectangular or square (possibly defined by two rods that represent the lateral sides of the rectangle, and are connected to each other), with the carrier extending parallel to a set of (lateral) sides (8) of the rectangle. The receiving positions (10*a*, 10*b*) are adapted to receive the devices and thereby engage the support surface (2), for example via two U- or C-shaped receivers (9) embracing the lateral sides of the support surface.

By providing the devices at an angle of a from each other, and for instance sliding them into the receiving positions in this way, it is ensured that the carriers are placed at this angle.

Figure 2A:
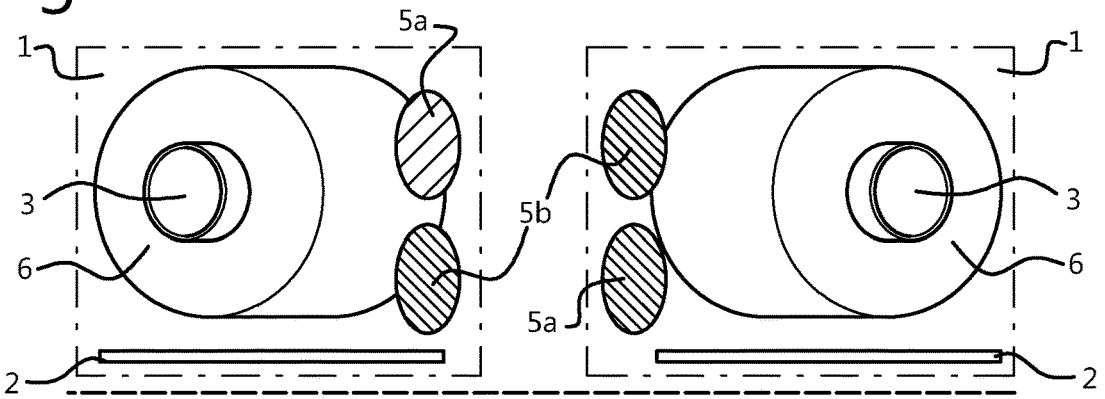
FIGS. 2A-C show a schematic representation of a second variation of a possible embodiment of the device, as well as placing an assembly of two devices in a creel.
Figure 2B:
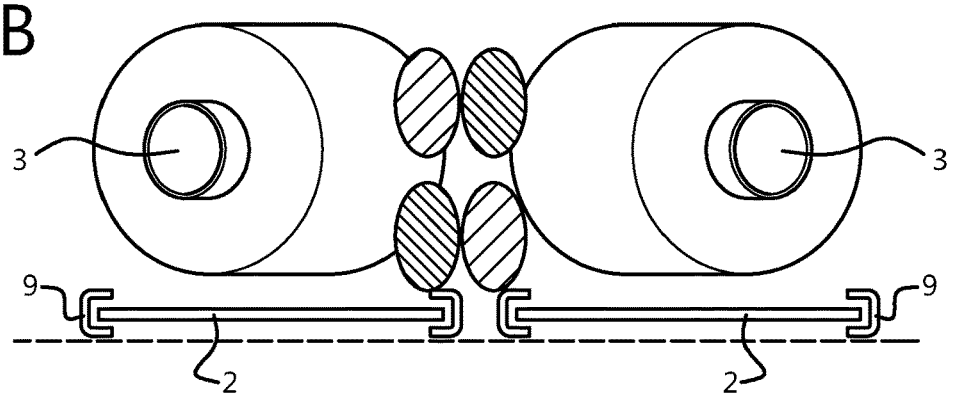
Figure 2C:
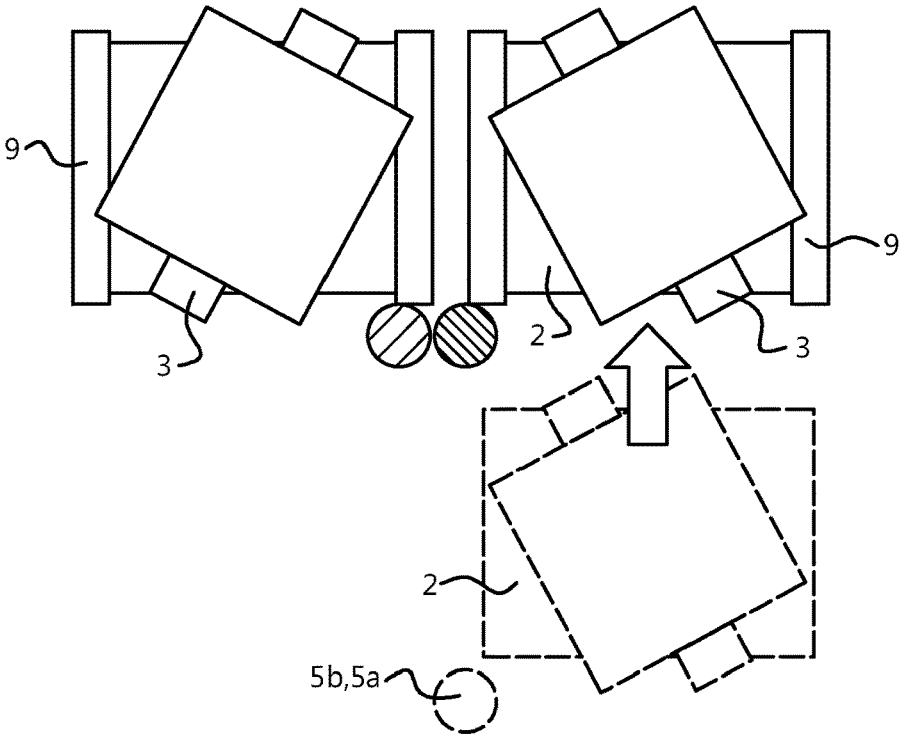

In a second embodiment thereof, visible in FIGS. 2A-C, the support surfaces are provided at the same angle at the receiving positions (10*a*, 10*b*), but the devices are adapted so that the left and right devices have a carrier that is at an angle of $\alpha/2$ or—$\alpha/2$ with respect to the sides of the device, and so return to the desired angle when assembled. This offers the advantage that the creel can be made more compact, but that the devices typically take up slightly more space. FIG. 2A shows the rear view of a device in transit, in which the carrier is at an angle to the sides of the support plate, allowing parallel placement of the two devices (in terms of sides of the support surface) in the creel (see FIGS. 2B and 2C).

Figure 3:
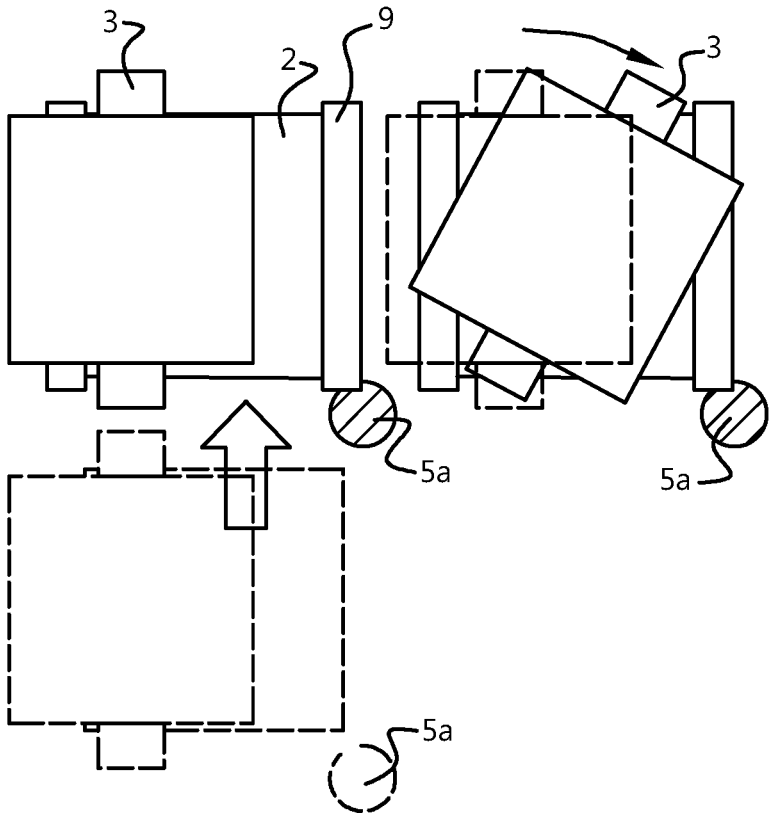
FIG. 3 shows a schematic representation of a third variation of a possible embodiment of the device, as well as placing an assembly of two devices in a creel.
Figure 4A:
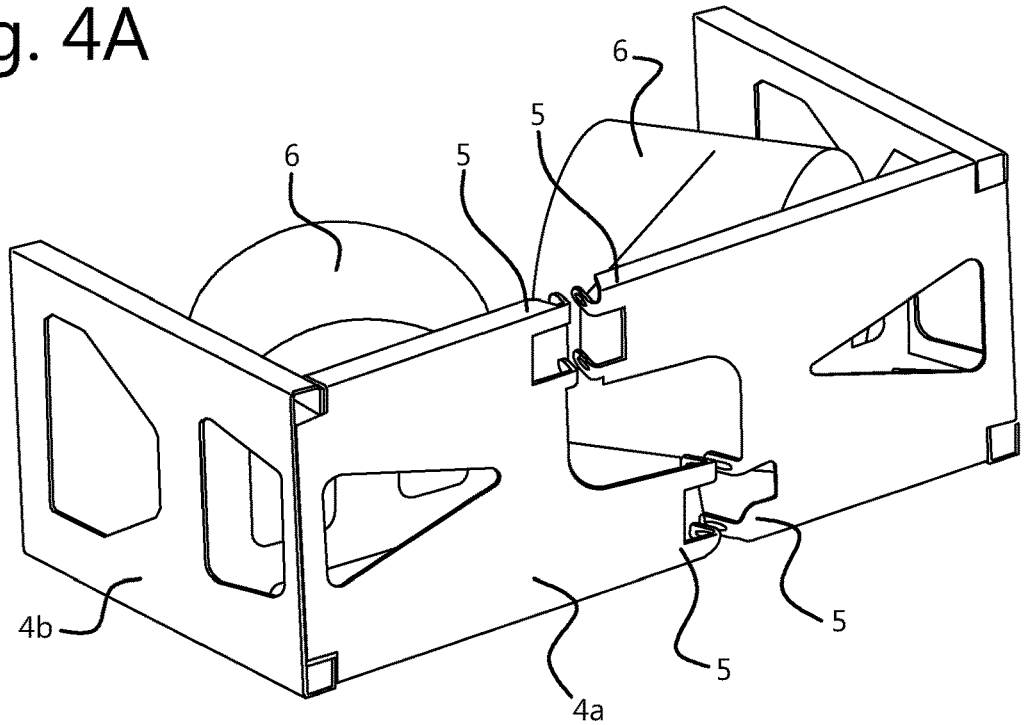
FIGS. 4A-D show a representation of a possible embodiment of two of the devices.
Figure 4B:
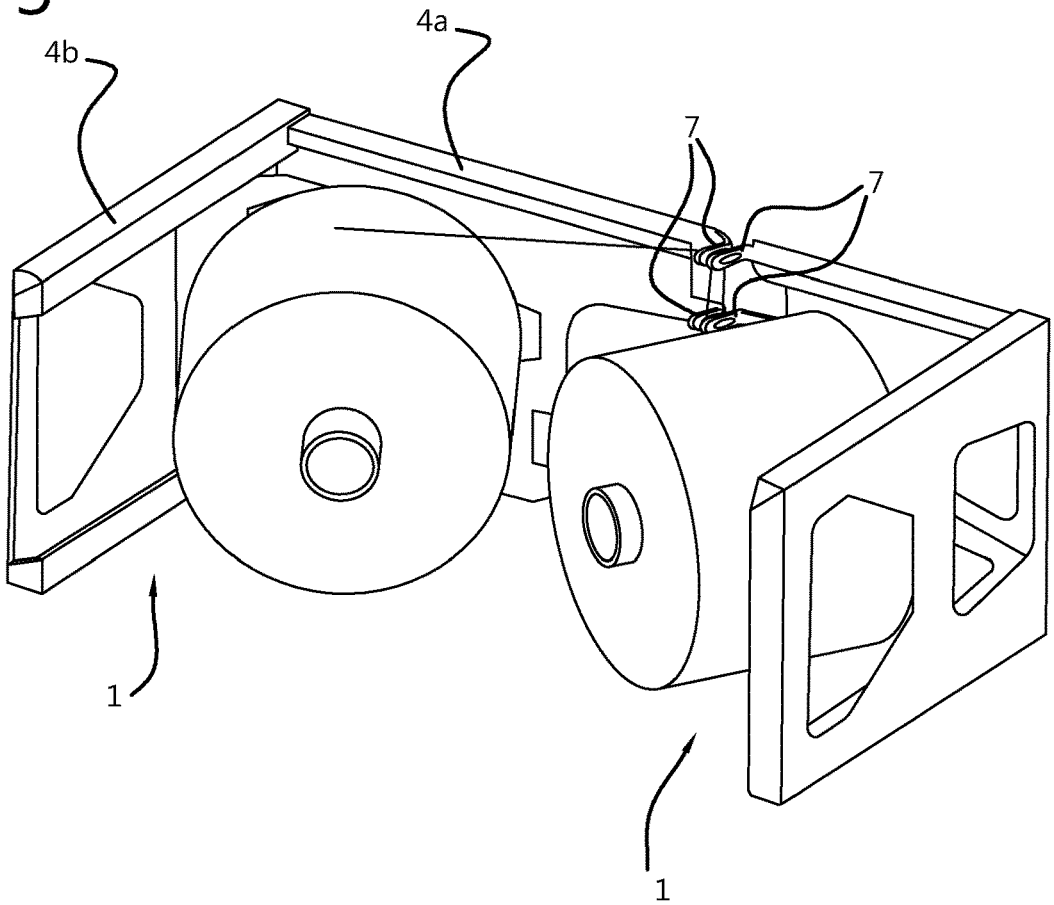
Figure 4C:
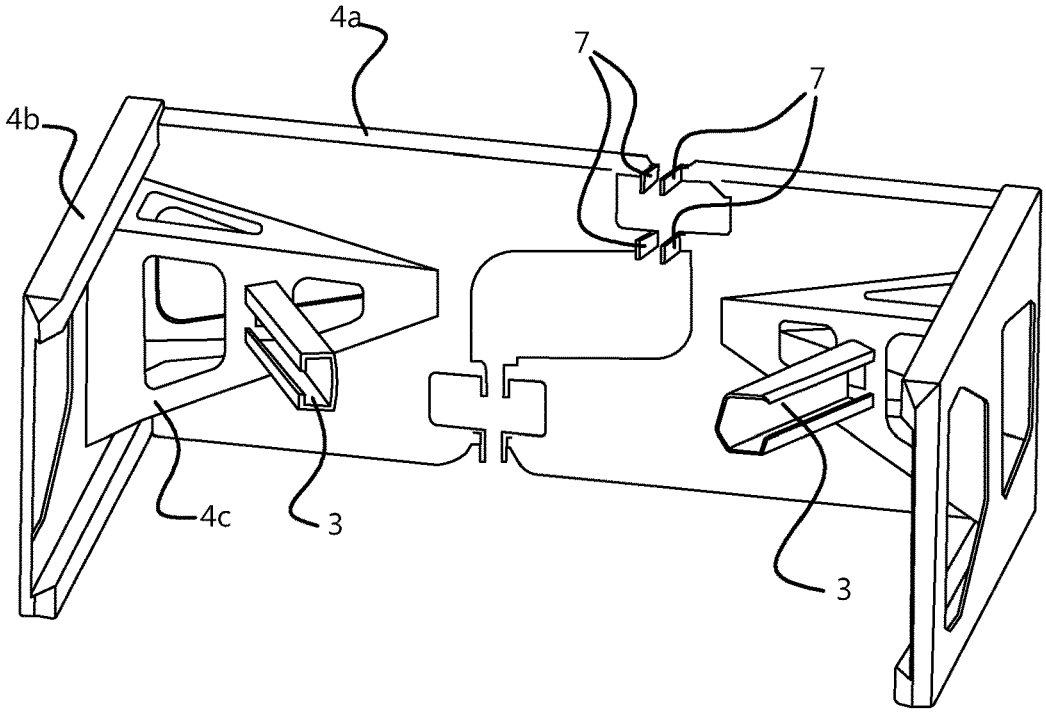
Figure 4D:
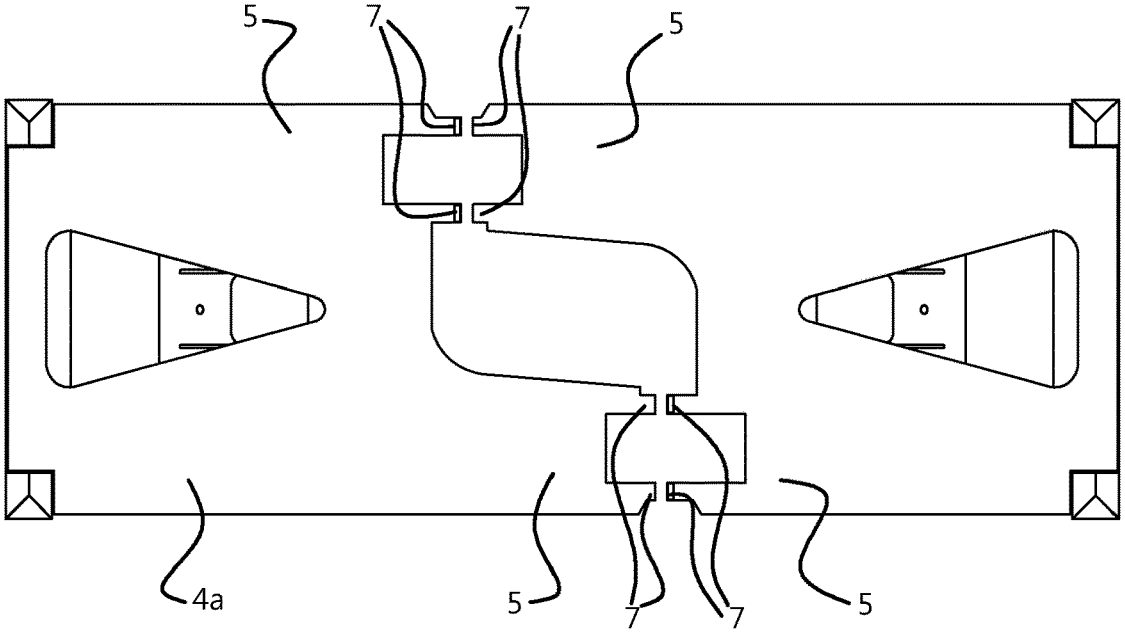

In FIGS. 1C, 2C and 3 the action of placing the device in the creel is visible from a top view, with in FIG. 3 also a rotation taking place to correctly orient the bobbin. Note also that the fixing members of a single device are positioned one above the other in this view, although this is by no means mandatory, as can also be seen in FIGS. 4A-D.

Example 2

In the fourth example, visible in FIGS. 4A-D, the device (1) is provided with a support surface defined by the sides of two upright plates (4*a*, 4*b*), which act as part of the support element together with a further connection (4*c*) between the two plates. The carrier (3) extends from this further connection (4*c*), approximately parallel to the support surface, and at an angle with respect to both plates between 30° and 60°. The fixing members (5) extend from one of the plates in an asymmetrical manner, with a first of the fixing members being closer to the point from which the carrier emerges from the rest of the device. Typically the tail end of the yarn (tag end) will be attached there as this end is often limited in length.

The fixing members in this embodiment, although by no means limiting, each have two holders (7) to hold the yarn ends at two points, and retain the yarn ends such that they interface with a yarn end of the other bobbin so that the tag end of one bobbin interfaces with the leading end of the other bobbin, and vice versa.

As can be seen in the figures, the two devices (1) are rotationally equivalent, through a rotation of 180° about the bisector formed by the axes of the two carriers, passing through the common run-off point. The two fixing members are positioned such that they interface with the fixing members of the second device due to the difference in position relative to the carrier. Nevertheless, the carriers may be rotatable relative to the device itself to ensure a desired angle (in the horizontal plane perpendicular to the two upright plates).

In this embodiment, the device can be fixed in the creel in several ways, such as purely on the basis of gravity and friction, resting on the two sides of the upright plates. Alternatively or additionally, one or both upright plates can also be used to fix the device.

The embodiment of FIGS. 4A-D allows easy loading of the device into the creel, immediately with the carrier at the desired angle, and also allows horizontal transport of the carrier and thus the bobbin held thereon.

It should be understood from the examples that the coupling mechanism via a support surface or support plate with U- or C-shaped receivers discussed therein is not to be considered restrictive in any way, and can simply be replaced by other coupling mechanisms, such as bars that slide one into the other, eye-hook connections, etc.

Example 3

Figure 5A:
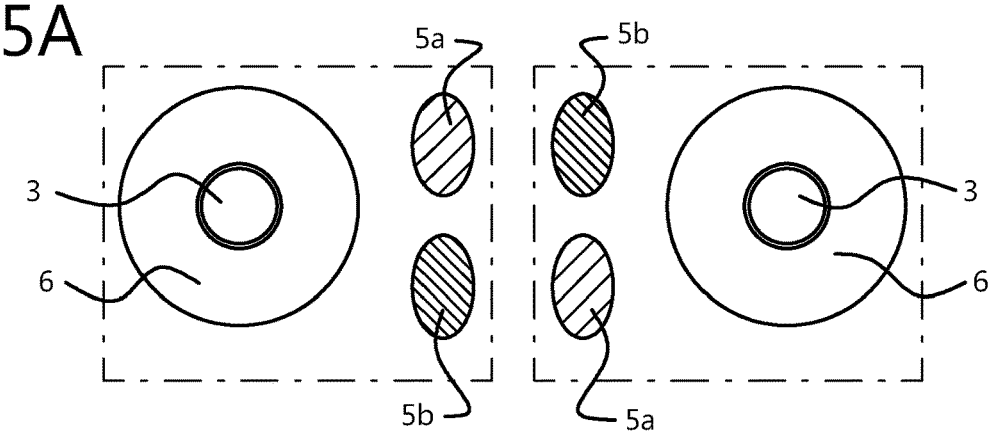
FIGS. 5A-C show a schematic representation of a first variation of an alternative embodiment of the device, as well as placing an assembly of two devices in a creel.
Figure 5B:
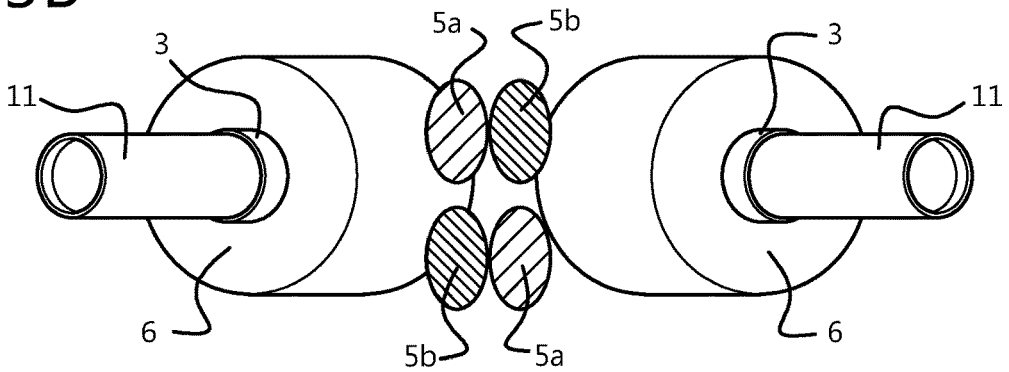
Figure 5C:
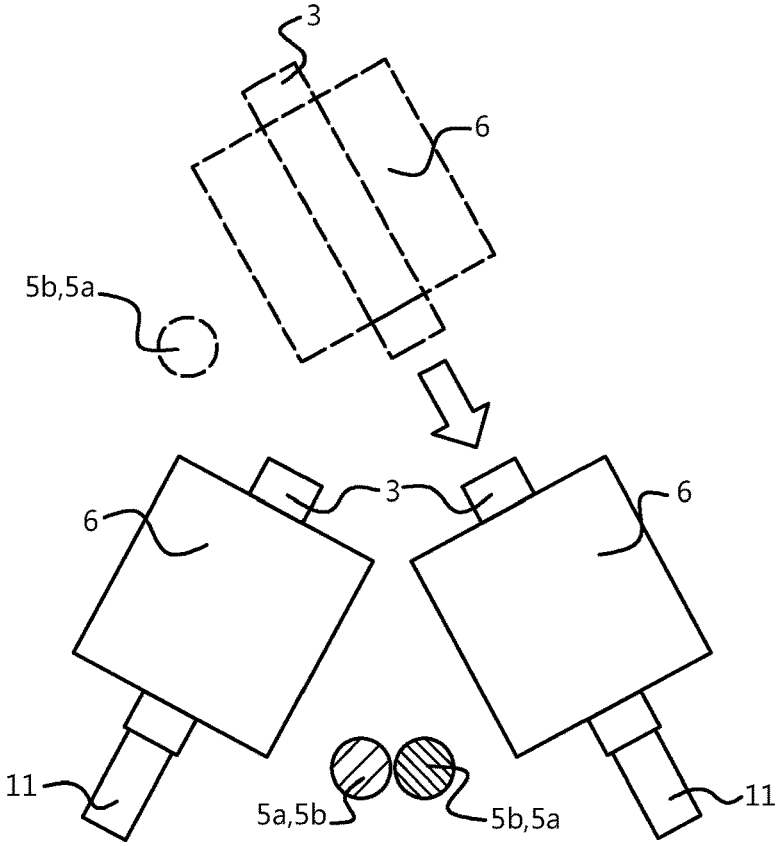

In the fifth example, according to FIGS. 5A-C, a further variant can be seen, where the coupling between receiving position and device takes place directly on the carrier (3), and the carrier (3) is received on an engaging mechanism (11) in the form of an elongate element that can be (partially) slid into the carrier (3). Preferably, the profile of carrier (3) and engaging mechanism (11) is similar, and such that they can be uniquely coupled, and thus there is no rotational freedom for the coupling. In this way it is ensured that the fixing members (5*a*, 5*b*) are immediately correctly oriented, as seen in FIG. 5C.

The invention claimed is:

1. A system for holding bobbins with yarn and joining the yarns of the bobbins to produce an elongated yarn, said system comprising:

a. a plurality of devices for transporting and positioning a bobbin with yarn for provision in a creel, the devices each comprising: an elongated bobbin carrier, for holding the bobbin with the yarn, which carrier extends from a support member from a first end of the carrier, and which carrier has a free second end, and the devices each comprising two fixing members for holding free yarn ends of the yarn on the bobbin; a first of the fixing members for holding a leading end of the yarn; a second of the fixing members for holding a tag end of the yarn;

b. a creel system comprising a plurality of receiving positions, each of the receiving positions adapted to receive one of the devices, which receiving positions are grouped into pairs of two receiving positions;

wherein the devices are provided with one or more engaging elements, and the receiving positions are provided with one or more engaging mechanisms for connecting to the engaging elements, the engaging mechanisms of the receiving positions of each pair being positioned such that:

the carriers of the devices received in the pair of receiving positions are orientated towards a common run-off point; and the first fixing member of a first device interfaces with the second fixing member of a second device; and the second fixing member of the first device interfaces with the first fixing member of the second device; and wherein interfacing fixing members have a minimum mutual distance which is at most 250 mm.

2. The system according to-claim 1, wherein the device comprises a substantially flat support surface, and wherein the bobbin carrier is connected to the support surface.

3. The system according to claim 2, wherein the carrier is rotatable with respect to the support surface.

4. The system according to claim 2, wherein the engaging mechanisms are adapted to engage the support surface.

5. The system according to claim 1, wherein the carrier is provided with a bobbin fixing element for retaining the bobbin on the carrier and preventing movement of the bobbin along a length of the carrier.

6. The system according to claim 5, wherein the carrier is provided with a rotational bobbin fixing element for retaining a bobbin on the carrier and preventing rotation of the retained bobbin about an axis substantially along the carrier.

7. The system according to claim 1, wherein at least one of the fixing members comprises at least two holders each for respectively holding one of the tag end or leading end of the yarn, at least one of the at least two holders of each fixing member defining a tension line along which the respective tag end or leading end of the yarn is tensioned at said fixing member.

8. The system according to claim 1, wherein one of the fixing members is positioned closer to the first end of the carrier than the other fixing members.

9. The system according to claim 1, wherein the engaging mechanisms and the engaging elements are uniquely connectable in a fixed mutual position and orientation.

10. The system according to claim 1, wherein the first or second device are a given device and the engaging mechanisms are adapted for releasably positioning the given device, and wherein positioning the given device in an engaging mechanism prevents rotation and translation of the given device relative to the receiving position.

11. The system according to claim 1, further comprising one or more connecting devices for connecting yarns connected to interfacing fixing members.

12. The system according to claim 1, wherein when two devices are provided in the receiving positions of the pair, the carriers of the two devices are hereby substantially mirror images of each other with respect to a first plane perpendicular to a second plane defined by the carriers of the first and second devices, and wherein a bisector of the carriers of the first and second devices lies in the second plane.

13. The system according to claim 1, wherein when two devices are provided in the receiving positions of the pair, the carrier and the fixing members of the first device and the second device are each other's rotational counterparts, with a rotation of 180° around the bisector between the two carriers.

* * * * *